US006400086B1

(12) United States Patent
Huter

(10) Patent No.: US 6,400,086 B1
(45) Date of Patent: Jun. 4, 2002

(54) LIGHT GUIDING DEVICE FOR AN OBLONG LIGHT SOURCE

(75) Inventor: Johannes Huter, Götzens (AT)

(73) Assignee: Zumtobel Staff GmbH., Dornbirn (AT)

( * ) Notice: Subject to any disclaimer, the term of this patent is extended or adjusted under 35 U.S.C. 154(b) by 0 days.

(21) Appl. No.: 09/673,780

(22) PCT Filed: Apr. 29, 1999

(86) PCT No.: PCT/AT99/00107

§ 371 (c)(1),
(2), (4) Date: Nov. 6, 2000

(87) PCT Pub. No.: WO99/56058

PCT Pub. Date: Nov. 4, 1999

(30) Foreign Application Priority Data

Apr. 29, 1998 (AT) ..... GM 280/98
May 12, 1998 (EP) ..... 98890139

(51) Int. Cl.[7] ..... H01J 13/46
(52) U.S. Cl. ..... 315/56; 362/217; 362/309; 362/310; 362/328

(58) Field of Search ..... 315/56; 362/147, 362/217, 275, 309, 310, 311, 328; 313/113, 116

(56) References Cited

U.S. PATENT DOCUMENTS 3,832,539 A * 8/1974 Oram ..... 240/41.3
4,188,657 A * 2/1980 Reibling ..... 362/348
5,183,323 A * 2/1993 Daniel ..... 362/32
5,199,787 A * 4/1993 King et al. ..... 362/310

FOREIGN PATENT DOCUMENTS

CH 389 538 7/1965
EP 0513 713 A2 11/1992
FR 2 668 838 5/1992

* cited by examiner

*Primary Examiner*—Haissa Philogene
(74) *Attorney, Agent, or Firm*—Karl Hormann

(57) ABSTRACT

Light guiding device for an elongate light source having a body of substantially tubular or tube sector shape of transparent material for substantially coaxially receiving the light source and provided at its internal surface with grooves, notches or the like extending parallel to the axis of the body and engaging each other.

14 Claims, 2 Drawing Sheets

LIGHT GUIDING DEVICE FOR AN OBLONG LIGHT SOURCE

BACKGROUND OF THE INVENTION

1. Field of the Invention

The present invention relates to a light guiding device for an elongate light source, especially a fluorescent tubular lamp, with a substantially tubular or tube sector body of transparent material for substantially coaxially receiving the light source and which at its internal surface is provided with grooves, notches or the like disposed parallel to the axis and engaging each other and having flanks.

2. Prior Art

A device of the kind mentioned in the introduction is known from Swiss patent 389 538. In the known device the grooves serve to disperse or fan out the distribution of light in a direction normal to the axis in order to reduce the light density immediately below the light source. The broad dispersion effect is attained by using pointed grooves with an vertical angle of about 60°. The question of light suppression relative to the direction of the axis of the light source is not addressed in the publication.

In elongate light sources such as fluorescent tubular lamps, distribution of light is often desired in practical applications which maintains a predetermined radiation angle outside of which light emitted from the light source is largely suppressed or faded out. Refractive or reflective devices may be used for such purpose. A known kind of reflective device is a reflective raster consisting of longitudinal and transverse reflector vanes. Combinations of refractive and reflective devices are also possible.

OBJECTS OF THE INVENTION

It is an object of the invention to provide a refractive light guiding

SUMMARY OF THE INVENTION device simplifying the construction of lamps and, more particularly, an alternative to reflective raster lamps which is more cost-efficient.

The object is accomplished by a device of the kind mentioned in the introduction which in accordance with the invention is characterized by the flanks of the grooves seen in section normal to the axis being inclined at an angle of 40° to 46°, preferably 43°, relative to the radial direction.

This results in a new improved kind of prismatic structure of a profile which is uniform throughout the length of the body. The function of the structure will be described in greater detail infra. The effect of the structure is a deflection of light rays closer to the radial direction. The light emission of a fluorescent tubular lamp enveloped (at least partially) by such a device is suppressed in an angular cone in the axial direction, i.e. the angle of emission normal to the axis of the fluorescent tubular lamp is restricted (for instance in a downward direction). As a result the usual vanes extending normal to the axis of reflective raster lamps are no longer required since the suppression of light in the longitudinal direction is taken over by the light guiding device in accordance with the invention.

Preferably, the grooves are distributed evenly over the internal circumference of the body, and in a particularly preferred embodiment there will be at least twenty grooves. In this manner the distribution of light over the range of emission is rendered more uniform.

In a preferred embodiment of the invention the flanks of the grooves are concave when seen in section normal to the axis. Scattering resulting from the structure of the grooves is thus minimized which leads to a sharper definition of the light suppression, and the degree of total light transmission (=efficiency) is maximized. Preferably, the radius of the flanks equals from half to twice the spacing between half the depth of the grooves and the axis of the body.

Preferably, the spacing between half the depth of the grooves and the axis of the body is between 1.4 to 1.7 times the radius of the light source to be received. This results in a particularly compact structure.

In any case, a refractive index of at least 1.45 of the transparent material is particularly advantageous since it causes the angle of suppression to be increased and the angle of emission to be decreased.

A further aspect of the invention relates to providing a lamp with an elongate light source, in particular a fluorescent light tube surmounted by a roof-like reflector and which is provided with a light guiding device of tubular structure enveloping the light source. In case a light guiding device structured as a tube sector is used it will surround the light source at its side opposite the reflector.

DESCRIPTION OF THE DRAWINGS

The invention will hereafter be described in greater detail with reference to the embodiment shown in the drawings. In the drawings

DESCRIPTION OF PREFERRED EMBODIMENTS

Figure 2:
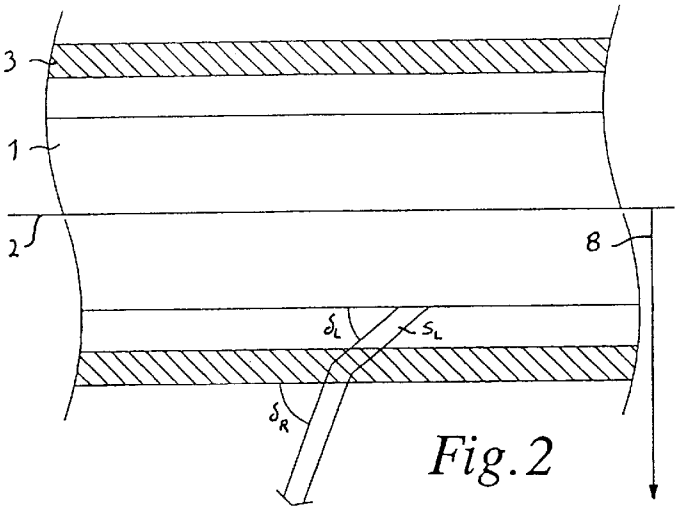
FIG. 2 depicts a part of the light source and the light guiding device of FIG. 1 in a schematic side elevation.
Figure 1:
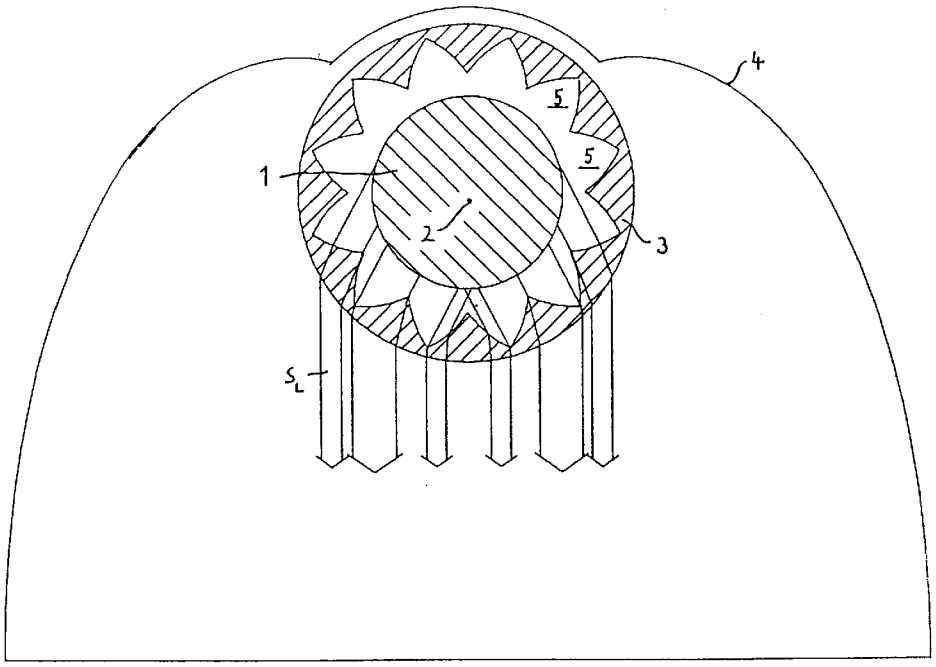
FIG. 1 depicts a lamp in section normal to its longitudinal axis.

The lamp shown in FIGS. 1 and 2 is provided with an elongate light source 1 shown as a fluorescent tubular lamp having a longitudinal axis 2 and disposed coaxially, with play, within the interior of a substantially tubular body 3 of transparent material having an index of refraction of, for instance, v=1,5. A trough-like or inversely U-shaped or partially parabolic reflector 4 is arranged in the manner of a roof above the light source 1 and the body 3.

The length of the lamp shown, in section in FIG. 1, in the direction of its axis 2 may be chosen as desired. Instead of a fluorescent tubular lamp any other conventional "elongate light source" is possible, such as, for instance, halogen tubes, linear arrays of individual light sources, e.g. light bulbs, etc. The axis 2 of the light source 2 need not necessarily be straight, but it may also be slightly curved or polygonal, in which case the body 3 would have to be conformed to the shape of the light source 1.

At its internal surface the body 3 is provided with grooves 5, notches or the like, extending parallel to the axis 2 and engaging each other. In the example shown, twelve grooves 5 are uniformly distributed over the internal circumference of the body 3.

Figure 3:
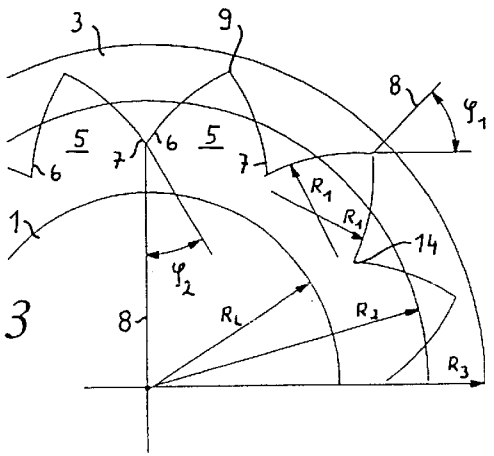
FIG. 3 is a sectional view showing the relationship of dimensions of an exemplary sectional portion of the light guiding device of FIG. 1.

As depicted in FIG. 3, the grooves 5, seen in section normal to the axis, have concave flanks 6, 7. The radius $R_1$ of the flanks 6, 7 measures from about half to about twice the spacing $R_2$ between half the depth of the grooves 5 and the common axis 2 of the light source 1 and of the body 3. The median angle $(\Phi_1+\Phi_2)/2$ of the flanks 6, 7 relative to a radial line 8, is about 40° to 46°, preferably about 43°. The spacing $R_2$ between about half the depths of the grooves 5 and the common axis 2 of the light source 1 and of the body 3 measures about 1.4 to 1.7 times the radius $R_L$ of the light source 1. The external radius $R_3$ of the body 3 is selected to be as small as possible, that is to say such that the body is of just about the necessary rigidity. The roots 9 of the grooves 5 thus extend closely to the external circumference of the body 3.

The number of grooves 5 may be chosen arbitrarily and is limited, in praxi, by manufacturing limits. The flanks 6, 7 of the grooves 5 may, of course, also be of planar shape.

The function of the device is as follows:

Light beams emitted from the light source 2 are not only deflected by the prismatic structure of the body 3 in a plane normal to the axis (as shown in FIG. 1) but also in every plane parallel to the axis, one of which is shown in FIG. 2. As may be seen in FIG. 2, when passing through the body 3, light beams $S_L$ inclined at an angle $\delta_L$ relative to the axis 2 are deflected more closely in the direction of the radial line 8, specifically by an angle $\delta_R>\delta_L$.

As may be seen in FIG. 1, the light emission pattern of the body 3 in every direction vertically of the axis is wider than the light source 1.

Figure 5:
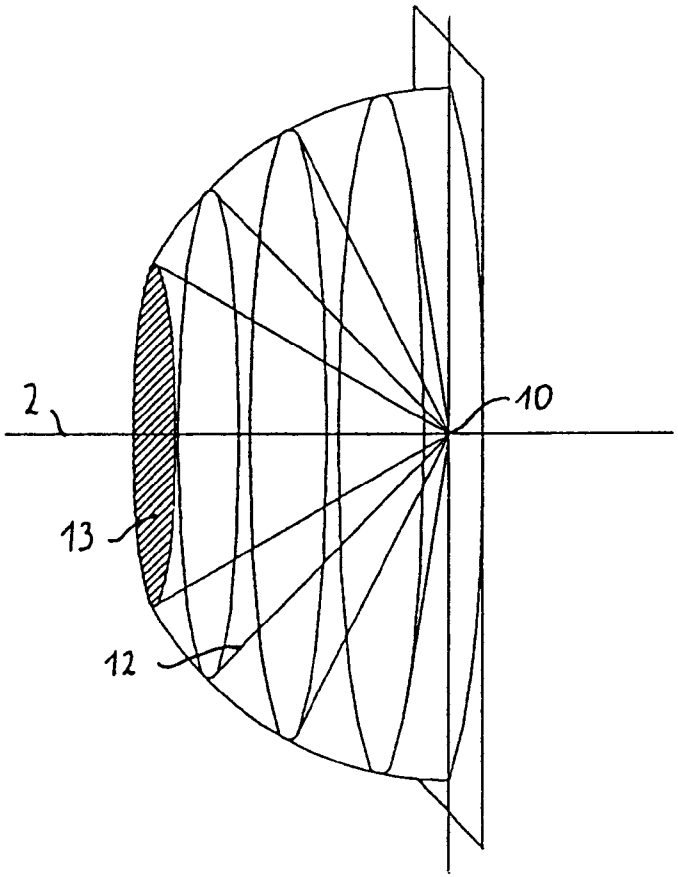
FIGS. 4 and 5 respectively show schematic radiation ratios from a point of the light source without (FIG. 4) and with (FIG. 5) a light guiding device.
Figure 4:
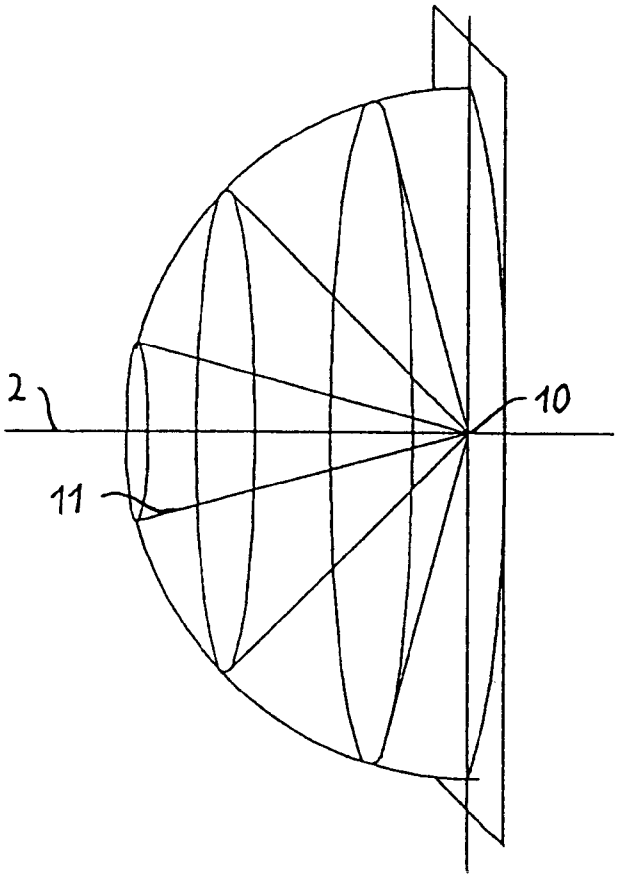

FIGS. 4 and 5 depict a spatial representation of the combination of the refractive effects drawn in FIGS. 1 and 2. All light beams emanating from a point 10 on the light source 2 at a conical angle 11 relative to the axis 2 (FIG. 4) are, upon insertion of the body 3 (FIG. 5), emitted as a "crushed" cone 12 with a light suppression cone 13 being generated surrounding the axis 2.

The light suppression cone 13 generates a downwardly directed limitation of the radiation angle of the lamp shown in FIG. 1 in a direction normal to the plane of the drawing which could otherwise only be achieved by transverse vanes disposed normal to the axis within the reflector 4. One advantage of such light guidance is that, beginning at a size of about $R_2=1.4\times R_L$, practically all the light will be emitted from the light guidance, i.e. hardly any light losses will occur, as would be caused by the reverse reflection into the light source from the transverse vanes of a reflection raster lamp the uppermost ridge of which is black.

Also in an upward direction, i.e. in the direction of the reflector 4, the light suppression has an advantageous effect in the axial direction since the light rays deflected from the range of light suppression increase the radiation intensity from the light source and body arrangement on the reflector 4 which is thus better utilized. A special advantage results in connection with reflectors which do not alter the angle of rays relative to the axis, so that the vertical angle of the light suppression cone of the entire lamp is not smaller than that of the light guide. Such reflectors may, for instance, be planar reflectors disposed normal to the axis serving as closures at both ends of the reflector 4, or they may be grooved reflectors extending parallel to the axis in which each point of the reflector has a tangential plane parallel to the axis where the angle of each ray is reflected relative to the axis but is not changed in value. Such reflectors do not reduce the light suppression of the light guide.

In a simplified embodiment the body 3 need not envelope the light source 2 omnilaterally. A tube sector body would be sufficient which partially surrounds the light source 2, for instance, at its side opposite the reflector 4, for instance by ¼, half, or ¾. The reflector as well as the body my have coinciding open portions, slots parallel to the axis or open sections and the like to provide unimpeded penetration of certain light rays from the light source. Such a variant would be useful for suspended ceiling lamps in which the body and the reflector are provided with an elongate slot at their upper surfaces, through which the ceiling would be irradiated directly from below to provide partial indirect illumination of a room.

The body 3 may be extruded from transparent polymeric material. Alternatively, the body 3 may be fabricated from an appropriately profiled foil which may be partially or completely bent around the light source. It is also possible to use several coaxial bodies 3 enclosing or surrounding (in engagement with each other or with play) each other, resulting in cascading of their effects, i.e. in an increased light suppression angle 13.

The light source 1 need not be of circular shape and need not be arranged coaxially of the body 3.

"Tubular" body 3 is understood to mean not only a cylindrically tubular body but also a generally tubular body, such as, for instance, of elliptical cross-section or a cross-section with straight sides and rounded corners.

The body 3 may engage the light source 1 in a manner different from the one shown, where the roots 14 formed between the flanks 6, 7 engage the outer circumference of the light source 1. Alternatively, the body 3 and external wall of the light source 1 may be a unitary structure, e.g. to form the envelope of a fluorescent tubular lamp.

An axial light suppression 13 of about 60 (cone angle) was obtained with an exemplary embodiment of 20 grooves, a refractive index of v=1.5; a flank angle $(\delta_1+\delta_2)/2$ of about 43 and ratios of $R_1/R_2=0.5$ to 2.0; $R_2/R_L=1.4$ to 1.7 and $R_3/R_L$ as small as possible.

What is claimed is:

1. A light guiding device for an elongate light source of predetermined radius extending along a predetermined first axis, comprising:

an elongate body of substantially transparent material extending along a second axis and comprising an internal surface adapted to be disposed substantially parallel to the first axis and provided with a plurality of abutting recesses of predetermined depth extending in a radial direction and having surfaces inclined at an angle of from about 40° to about 46° relative to the radial direction.

2. The device of claim 1, wherein the angle measures 43°.

3. The device of claim 1, wherein the light source comprises an elongate tubular body and the internal surface of the transparent body is disposed substantially concentrically relative to the light source.

4. The device of claim 3, wherein the transparent body is of substantially tubular configuration adapted to be disposed at a predetermined spacing from the axis.

5. The device of claim 3, wherein the transparent body is of arcuate cross-sectional configuration.

6. The device of claim 3, wherein the recesses are elongate grooves extending substantially parallel to the axis.

7. The device of claim 4, wherein the grooves are distributed substantially uniformly over the internal surface.

8. The device of claim 7, wherein the plurality is at least twenty.

9. The device of claim 6, wherein the inclined surfaces comprise flanks of substantially concave configuration.

10. The device of claim 9, wherein the concave flanks have a radius measuring from about half to about twice the spacing between half the depth of the recesses and the second axis.

11. The device of claim 1, wherein the spacing between half the depth of the recesses and the second axis measures from about 1.4 to about 1.7 times the radius of the light source.

12. The device of claim 1, wherein the transparent material has a refractive index of at least 1.45.

13. The device of claim 4, further comprising a reflector having at least two elongate sections inclined relative to each other and mounted substantially symmetrically over the body.

14. The device of claim 5, further comprising a reflector having at least two elongate sections inclined relative to each other and mounted substantially symmetrically over the arcuate body at its side exposing the light source.

* * * * *